US006226815B1

(12) United States Patent
Mink et al.

(10) Patent No.: US 6,226,815 B1
(45) Date of Patent: May 8, 2001

(54) FITTED CRIB SHEET

(75) Inventors: Franklin Mink, Cranbury; Bruce Strongwater, Englewood, both of NJ (US)

(73) Assignee: J. Lamb, Inc., Englewood, NJ (US)

( * ) Notice: Subject to any disclaimer, the term of this patent is extended or adjusted under 35 U.S.C. 154(b) by 0 days.

(21) Appl. No.: 09/426,213

(22) Filed: Oct. 25, 1999

(51) Int. Cl.[7] ..... A47G 9/02
(52) U.S. Cl. ..... 5/497; 5/482; 112/475.08
(58) Field of Search ..... 5/497, 496, 498, 5/495, 482, 499, 502, 500; 112/475.08

(56) References Cited

U.S. PATENT DOCUMENTS

| | | | | |
|---|---|---|---|---|
| 4,662,013 | | 5/1987 | Harrison | 5/497 |
| 4,703,530 | * | 11/1987 | Gusman | 5/497 |
| 4,727,608 | | 3/1988 | Joyce | 5/497 |
| 4,777,677 | | 10/1988 | Dugan | 5/497 |
| 4,825,489 | | 5/1989 | Ross | 5/497 |
| 5,479,664 | | 1/1996 | Hollander | 5/499 |
| 5,491,853 | | 2/1996 | Turnbull | 5/497 |
| 5,530,979 | | 7/1996 | Whitley | 5/500 |
| 5,625,912 | | 5/1997 | McCain et al. | 5/497 |
| 5,809,593 | | 9/1998 | Edwards | 5/482 |
| 5,901,389 | * | 5/1999 | Manner | 5/497 |
| 5,996,148 | * | 12/1999 | McCain et al. | 5/497 |

* cited by examiner

*Primary Examiner*—Alexander Grosz
(74) *Attorney, Agent, or Firm*—Abelman, Frayne & Schwab

(57) ABSTRACT

A fitted crib safety sheet for positioning over a crib mattress is made with a rectangular portion sized to fit over the top of the mattress. Side skirts are positioned on each side of the rectangular portion, and are sized to extend both down from the rectangular portion adjacent the sides of the mattress and then underneath the mattress. End flaps are positioned at each end of the rectangular portion, and are sized to not only extend down sides of the mattress but also to extend beneath the mattress. Corners of the sheet are sewn to conform to the corners of the mattress. A wide elastic strip is sewn to each end flap along the lateral width of the end flap. Then a narrow elastic strip is sewn to each side skirt along the longitudinal length of the side skirt and also sewn to the wide elastic stip.

24 Claims, 3 Drawing Sheets

FITTED CRIB SHEET

BACKGROUND OF THE INVENTION

This invention relates to a baby crib sheet that is constructed to prevent or greatly reduce the possibility that a baby will be able to remove the sheet from a crib mattress.

Fitted sheets for bed mattresses are well known. See, for example, U.S. Pat. No. 5,530,979 to Whitley, which shows a fitted sheet having an elastic underskirt for resiliently gripping the mattress to hold the sheet on the mattress. The fitted sheet shown in this patent has corners sewn to fit the substantially square corners of the mattress. A problem with this construction is that since the sheet does not extend substantially under the mattress, the sheet can be pulled off rather easily, which is a safety problem with infants.

See also U.S. Pat. No. 5,809,593 to Edwards, which illustrates a mattress cover having a wide continuous elastic strip sewn to the outer edges of a rectangularly shaped mattress cover. No attempt is made in the Edwards cover to provide a fitted cover having sewn corners, matching the corners of the mattress. The reason for this is to allow the sheet to be used with different sized mattresses.

A need exists for a fitted sheet which can be used with a baby's crib mattress and constructed to prevent a baby from removing the sheet from the mattress to thereby reduce the possible suffocation of the infant.

It is also an object of the invention to provide a crib sheet construction that will meet the "10-pound pull test" established by Good Housekeeping.

SUMMARY OF INVENTION

A fitted crib safety sheet for positioning over a crib mattress is made with a rectangular portion sized to fit over the top of the mattress. Side skirts are positioned on each side of the rectangular portion, and are sized to extend down from the rectangular portion adjacent the sides of the mattress with a free edge which is sized to extend beneath the mattress. End flaps are positioned at each end of the rectangular portion, and are sized to not only extend down the mattress but also to extend beneath the mattress. Corners of the sheet are sewn to conform to the corners of the mattress. A wide elastic stip is sewn to each end flap along a portion of the lateral width of the end flap. Further in a first embodiment a complete loop of a narrow elastic strip is sewn to each side skirt along the longitudinal length of the fee edge of the side skirt, turns a corner, and then is sewn to the wide elastic stip joined with each end flap. In a second embodiment, the narrow elastic strip is sewn along the longitudinal length of the free edge of each side skirt, turns a corner, and is then only sewn along a portion of the wide elastic strip joined with each end flap.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF PREFERRED EMBODIMENTS

Figure 1:
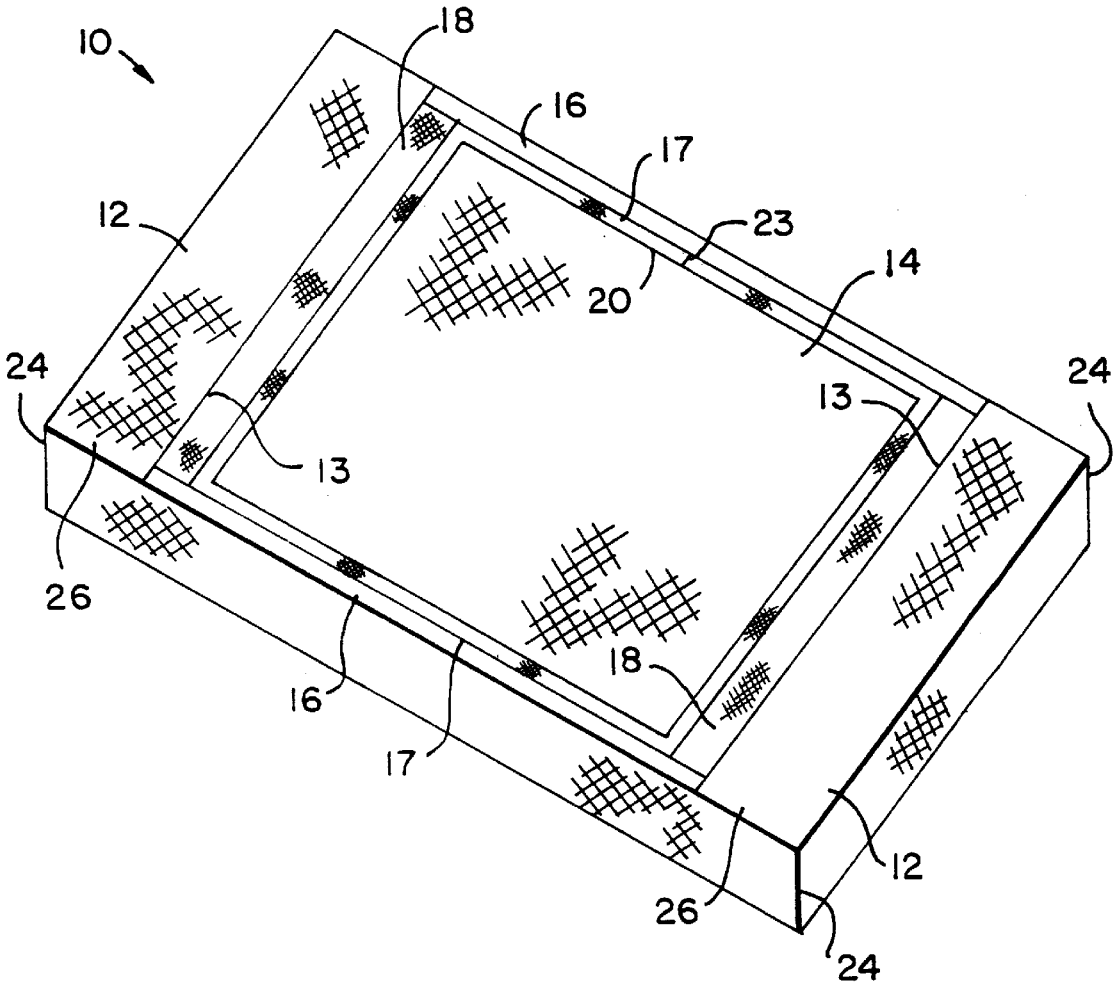
FIG. 1 is a perspective view of the underside of a fitted crib safety sheet in accordance with the present invention.
Figure 2:
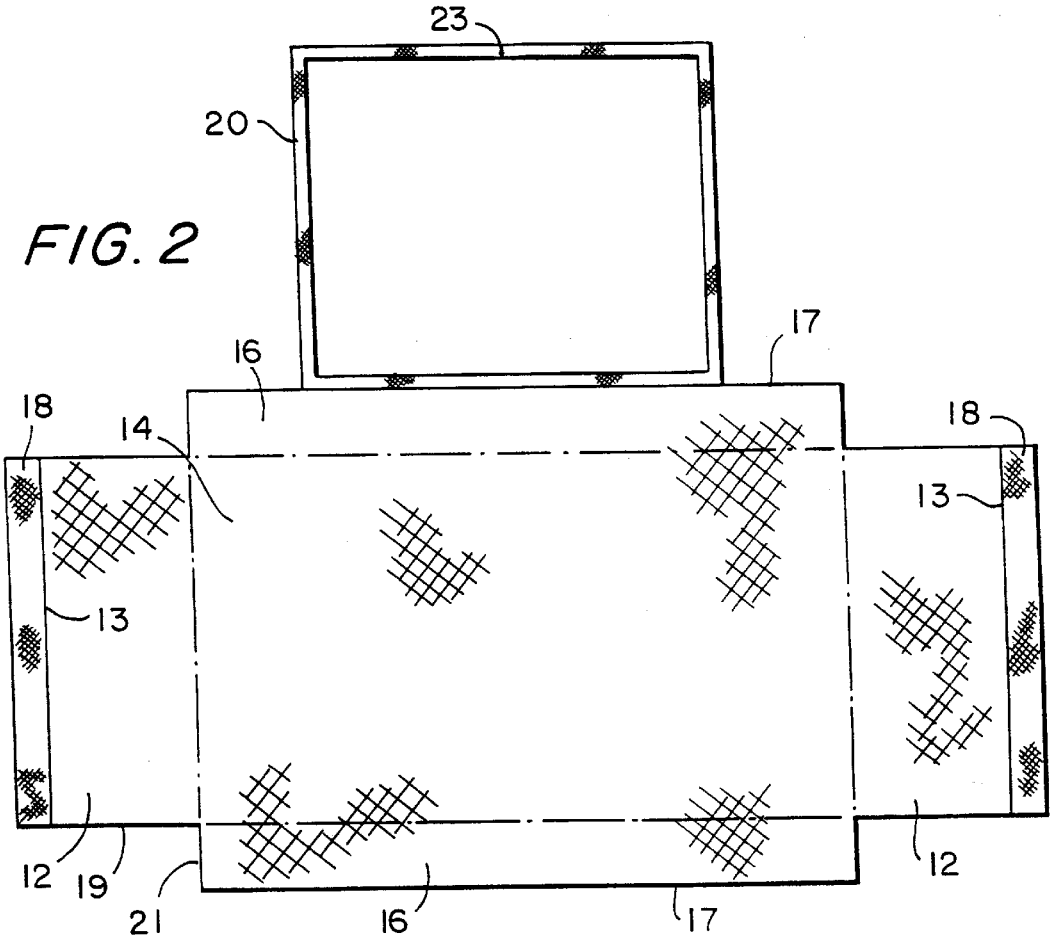
FIG. 2 is a flattened plan view of a fitted crib safety sheet shown in FIG. 1 before sewing the corners.

A preferred embodiment of fitted crib safety sheet 10 for use with a mattress (not shown) is illustrated in FIGS. 1 and 2. Sheet 10 is adapted to cover a standard crib mattress measuring 24 inches by 54 inches. The sheet includes end flaps 12 which extend from a rectangular center portion 14 outward to free edges 13. Edge 13 is positioned underneath the mattress so that flaps 12 extend in a preferred embodiment a distance of about six to about eight inches underneath the mattress. Sheet 10 further includes side skirts 16 which extend from center portion 14 outward to free edges 17. Edges 17 are also positioned underneath the mattress so that the side skirts 16 extend in a preferred embodiment a distance of about three inches to five inches underneath the mattress. In another embodiment, each of the flaps 12 extend underneath the mattress a distance equal to about 10% to 15% of the length of the mattress and each of the skirts 16 extend under the mattress a distance equal to 10% to 15% of the width of the mattress.

Wide elastic strips 18 are sewn to opposite free edges 13 of end flaps 12. In a preferred embodiment these strips are made from Product No. K200 2" White Knitted Elastic manufactured by Allied Elastic Braid, Inc. A narrow elastic strip 20 is sewn in a loop by having opposite ends joined at sewn ends 23. In a preferred embodiment, this strip is constructed from a Product No. 1040 ¼" White manufactured by Allied Elastic Braid, Inc. A portion of the narrow elastic strip 20 is then sewn to one of the free edges 17.

To form the fitted sheet shown in FIG. 1, end flaps 12 and side skirts 16, as shown in FIG. 2, are folded generally perpendicular to rectangular center portion 14. Mating edges, such as 19 and 21 shown in FIG. 2 are sewn together to form a corner 24 as shown in FIG. 1. Since edge 19 is longer than edge 21, a portion of edge 19 is left free and unsewn. This sewing of adjacent pieces is repeated at all four corners. The narrow elastic strip 20 is sewn to opposite free edges 17 of side skirts 16 and also to the opposite wide elastic strips 18 joined to opposite free ends 13.

Figure 3:
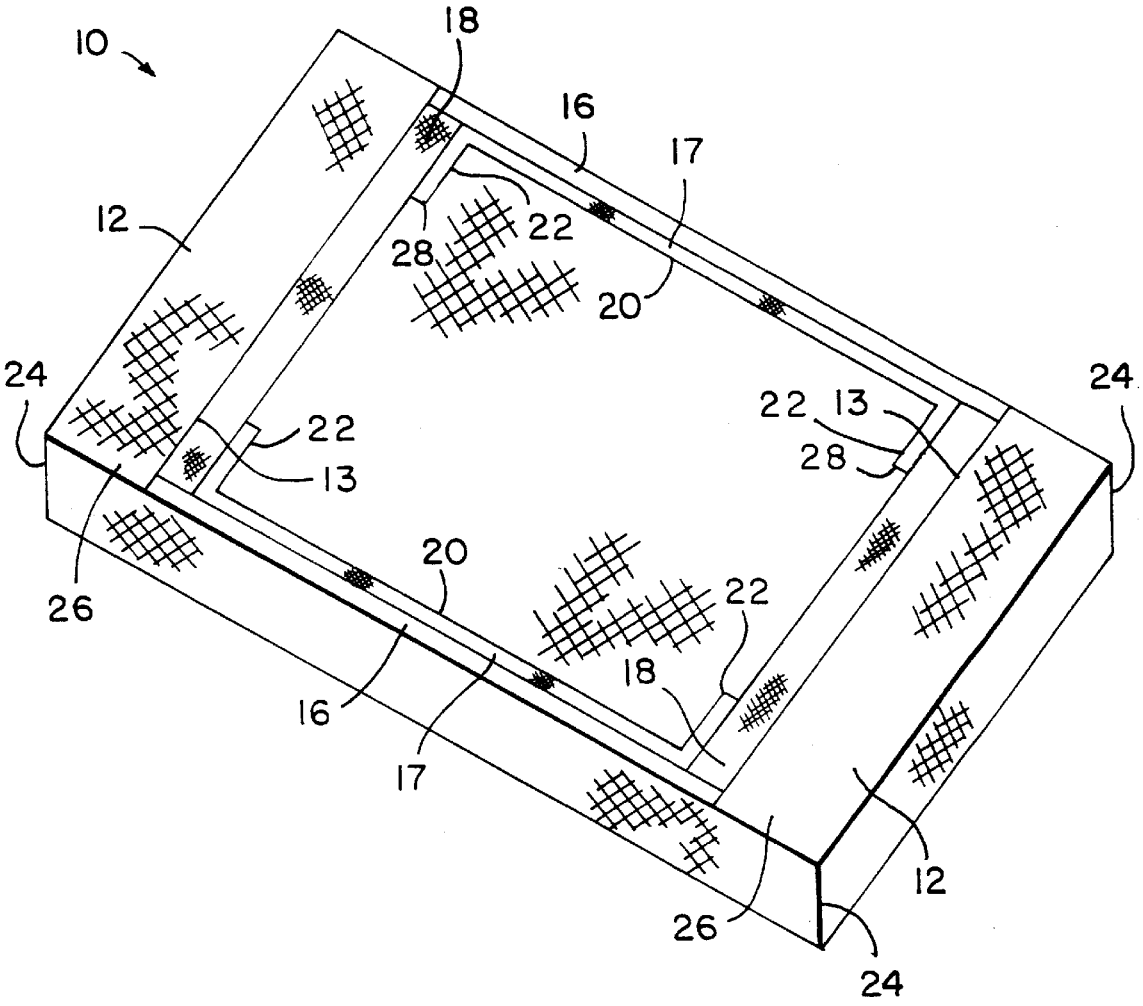
FIG. 3 is a perspective view of a second embodiment of the underside of a fitted crib safety sheet in accordance with the present invention.

In a second embodiment, narrow elastic strip 20 is not made as one continuous loop, but rather is attached as two separate elongated strips as shown in FIG. 3. Like numbers will be used in the FIGS. 3 and 4 to identify similar elements as those identified in the preferred embodiment.

Figure 4:
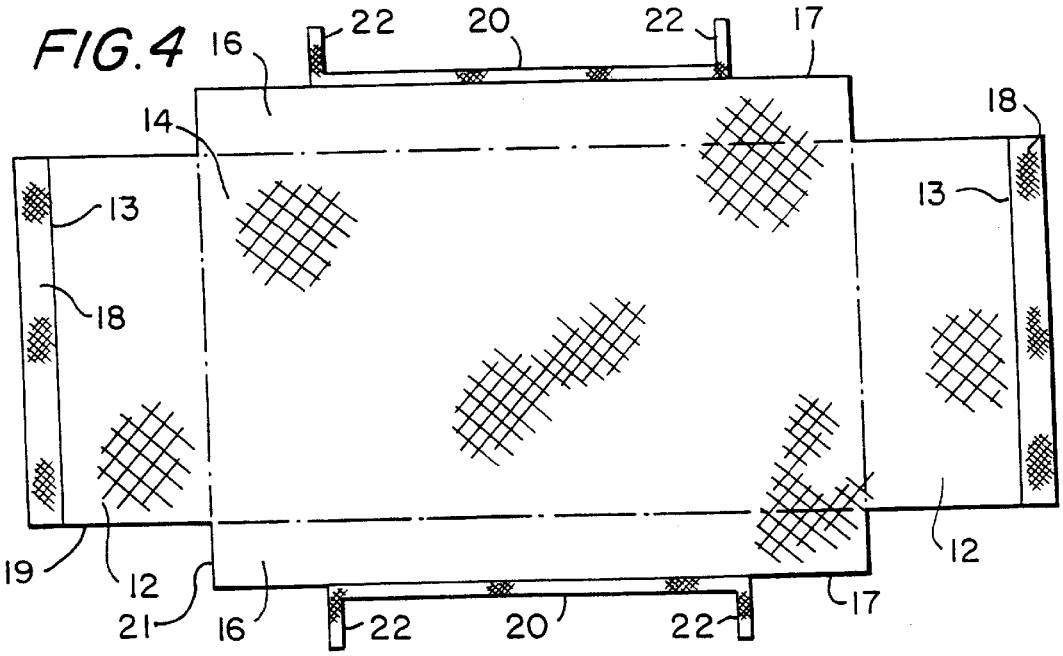
FIG. 4 is a flattened plan view of a fitted crib safety sheet shown in FIG. 3 before sewing the corners.

Each narrow strip 20 has two free ends 22. The two narrow strips 20 are each sewn to a free edge 17 in such a way so as to leave four free ends 22 as best seen in FIG. 4. Fitted crib safety sheet 10 is assembled in the second embodiment in the same manner as in the preferred embodiment except all four free ends 22 of elastic strips 20 are sewn to only a portion of the wide elastic strips 18 as shown in FIG. 3.

In operation, fitted sheet 10 is placed with the top portion 14 on the top surface of the mattress. End flaps 12 are then drawn outwardly away from the mattress and slipped over and under the ends of the mattress against the resilient force provided by elastic strips 20. Side skirts 16 are then drawn down the sides of the mattress. Since end extensions 12 are completely beneath the mattress and all corners sewn closed, the fitted sheet cannot be easily removed from the mattress by an infant.

Sheets constructed as described herein were submitted to Good Housekeeping for safety testing. Good Housekeeping has advised that these sheets successfully passed the "10-pound pull test."

The sheets constructed according to the present invention have been designed to greatly reduce, if not eliminate altogether, the dangers that exist when a baby tries to pull a fitted crib sheet loose from a mattress.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

What is claimed is:

1. A fitted crib sheet for a crib mattress having length and width comprising:

a rectangularly shaped central portion having a lengthwise axis and a perpendicular widthwise axis;

end flaps extending away from opposite ends of the central portion in the lengthwise direction and having a distal fee edge extending in the widthwise direction;

side skirts extending away from opposite sides of the central portion in the widthwise direction and having a distal free edge extending in the lengthwise direction, the end flaps and the side skirts being generally rectangular;

the end flaps being sized to have a width in the lengthwise direction sufficient for positioning a portion of each end flap underneath the mattress;

the side skirts being sized to have a width in the widthwise direction sufficient for positioning a portion of each side skirt underneath the mattress;

at least one elastic strip sewn along each edge of each end flap;

an elastic strip sewn along each free edge of each side skirt; and an edge of said side skirt, extending in the widthwise direction, sewn to a portion of an adjacent edge, extending in the lengthwise direction of each end flap wherein the elastic stips sewn to the side skirts have a predetermined length at each end of each strip which is not sewn to the side skirts, and wherein the predetermined lengths are sewn to the corresponding adjacent elastic strips sewn to the end flaps.

2. The fitted crib sheet according to claim 1 wherein the elastic strips sewn to the side skirts have a width less than one-half the width of the elastic strips sewn to the end flaps.

3. The fitted crib sheet according to claim 2 wherein the width of the portion each side skirt extending underneath the mattress plus the width of the elastic strip sewn to each side skirt is in the range from about one to four inches.

4. The fitted crib sheet according to claim 3 wherein the elastic strip sewn along each free edge of each side skirt is also sewn along one of the elastic strips sewn to each end flap.

5. The fitted crib sheet according to claim 4 wherein the elastic strip sewn along the side skirts and end flaps is continuous.

6. The fitted crib sheet according to claim 1 wherein the width of the end flap is at least twice the width of the side skirts.

7. The fitted crib sheet according to claim 1 wherein the elastic strips sewn to the end flaps are constructed of a knitted elastic material having at least a two-inch width.

8. The fitted crib sheet according to claim 1 wherein the elastic strips sewn to the side skirts are constructed of a knitted elastic material having at least a ¼-inch width.

9. The fitted crib sheet according to claim 1 wherein the portion of the end flaps extending underneath the mattress extend for a distance of at least six inches.

10. The fitted crib sheet according to claim 1 wherein the portion of the side skirts extending underneath the mattress extend for a distance of at least three inches.

11. The fitted crib sheet according to claim 1 wherein the portion of the end flaps extending underneath the mattress extend a distance equal to at least 10% of the length of the crib mattress.

12. The fitted crib sheet according to claim 1 wherein the portion of the side skirts extend underneath the mattress extends a distance equal to at least 10% of the width of the crib mattress.

13. A method for manufacturing a crib sheet for a crib mattress, said mattress having a length and width, said method comprising:

providing a sheet having a rectangular shaped central portion with a lengthwise axis and perpendicular widthwise axis;

providing generally rectangular end flaps extending away from opposite ends of the central portion in the lengthwise direction and having a distal free edge extending in the widthwise direction;

providing generally rectangular side skirts extending away from the opposite sides of the central portion in the widthwise direction and having a distal free edge extending in a lengthwise direction;

the end flaps being sized to have a width in the lengthwise direction sufficient for positioning a portion of each end flap underneath the mattress;

the side skirts being sized to have a width in the widthwise direction sufficient for positioning a portion of each side skirt underneath the mattress;

sewing an elastic strip along each free edge of each end flap;

sewing an elastic strip along each free edge of each side skirt; and sewing an edge of each side skirt extending in the widthwise direction, to a portion of an adjacent edge extending in the lengthwise direction of each end flap, wherein the elastic strips sewn to the side skirts have a predetermined length at each end of each strip which is not sewn to the side skirts and the predetermined lengths are sewn to the corresponding adjacent elastic strips sewn to the end flags.

14. The method according to claim 13 wherein the elastic strips sewn to the side skirt elastic have a width less than one-half the width of the elastic strips sewn to the end flaps.

15. The method according to claim 14 wherein the width of the portion each side skirt extending underneath the mattress plus the width of the elastic strip sewn to each side skirt is in the range from about one to four inches.

16. The method according to claim 15 wherein the elastic strip sewn along each free edge of each side skirt is also sewn along one of the elastic strips sewn to each end flap.

17. The method according to claim 16 wherein the elastic strip sewn along the side skirts and end flaps is continuous.

18. The method according to claim 14 wherein the width of the end flap is at least twice the width of the side skirts.

19. The method according to claim 13 wherein the elastic strips sewn to the end flaps are constructed of a knitted elastic material having at least a two-inch width.

20. The method according to claim 13 wherein the elastic strips sewn to the side skirts are constructed of a knitted elastic material having at least a ¼-inch width.

21. The method according to claim 13 wherein the portion of the end flaps extending underneath the mattress extend for a distance of at least six inches.

22. The method according to claim 13 wherein the portion of the side skirts extending underneath the mattress extend for a distance of at least three inches.

23. The method according to claim 13 wherein the portion of the end flaps extending underneath the mattress extend a distance equal to at least 10% of the length of the crib mattress.

24. The method according to claim 13 wherein the portion of the side skirts extending underneath the mattress extends a distance equal to at least 10% of the width of the crib mattress.

* * * * *